US010629071B1

(12) United States Patent
Zheng et al.

(10) Patent No.: US 10,629,071 B1
(45) Date of Patent: Apr. 21, 2020

(54) ADAPTIVE TRAFFIC CONTROL USING VEHICLE TRAJECTORY DATA

(71) Applicant: BEIJING DIDI INFINITY TECHNOLOGY AND DEVELOPMENT CO., LTD., Beijing (CN)

(72) Inventors: Jianfeng Zheng, Beijing (CN); Xianghong Liu, Tianjin (CN)

(73) Assignee: BEIJING DIDI INFINITY TECHNOLOGY AND DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 16/217,003

(22) Filed: Dec. 12, 2018

Related U.S. Application Data

(63) Continuation of application No. PCT/CN2018/110417, filed on Oct. 16, 2018.

(51) Int. Cl.
*G08G 1/01* (2006.01)
*G08G 1/095* (2006.01)
*G08G 1/08* (2006.01)

(52) U.S. Cl.
CPC ..... *G08G 1/0145* (2013.01); *G08G 1/0112* (2013.01); *G08G 1/0129* (2013.01); (Continued)

(58) Field of Classification Search
CPC .... G08G 1/0145; G08G 1/095; G08G 1/0133; G08G 1/08; G08G 1/0129; G08G 1/0112
See application file for complete search history.

(56) References Cited

U.S. PATENT DOCUMENTS 5,530,441 A * 6/1996 Takatou ..... G08G 1/08 340/937
6,633,238 B2 * 10/2003 Lemelson ..... G08G 1/07 340/905

(Continued)

FOREIGN PATENT DOCUMENTS

CN 104332062 A 2/2015
CN 106875702 A 6/2017

(Continued)

OTHER PUBLICATIONS

International Search Report in PCT/CN2018/110417 dated Jul. 29, 2019, 5 Pages.

(Continued)

*Primary Examiner* — Omer S Khan
(74) *Attorney, Agent, or Firm* — Metis IP LLC

(57) ABSTRACT

Embodiments of the disclosure provide traffic control systems and methods. The traffic control system may include a communication interface configured to receive vehicle trajectory data acquired by sensors and traffic control data from traffic signal controllers. The traffic control system may further include at least one processor. The at least one processor may be configured to detect an abnormal traffic condition. The at least one processor may be further configured to optimize an online traffic control scheme based on the vehicle trajectory data by adjusting green splits for a plurality of phases. The at least one processor may be also configured to provide, in real-time, the optimized online traffic control scheme to a traffic signal controller for generating traffic control signals.

18 Claims, 7 Drawing Sheets

(52) U.S. Cl.
CPC ..... *G08G 1/0133* (2013.01); *G08G 1/08* (2013.01); *G08G 1/095* (2013.01)

(56) References Cited

U.S. PATENT DOCUMENTS

| | | | | |
|---|---|---|---|---|
| 2002/0008637 | A1* | 1/2002 | Lemelson | G08G 1/07 340/907 |
| 2013/0336583 | A1* | 12/2013 | Ernst | G06T 7/251 382/165 |
| 2014/0278052 | A1* | 9/2014 | Slavin | G01C 21/3492 701/400 |
| 2016/0027299 | A1* | 1/2016 | Raamot | G08G 1/08 340/917 |
| 2017/0154525 | A1* | 6/2017 | Zou | G08G 1/0145 |
| 2017/0186314 | A1* | 6/2017 | Bernhardt | G08G 1/0112 |

FOREIGN PATENT DOCUMENTS

| | | | | |
|---|---|---|---|---|
| CN | 107170256 | A | 9/2017 | |
| CN | 106251655 | B | 6/2018 | |
| CN | 105761515 | B | 7/2018 | |
| FR | 2668631 | A1 | 4/1992 | |
| JP | 2014026604 | A | 2/2014 | |
| TW | 201814670 | A | 4/2018 | |
| TW | 201832190 | A | 9/2018 | |
| WO | 2018141403 | A1 | 8/2018 | |
| WO | WO2018-141403 | * | 8/2018 | G08G 1/0112 |
| WO | 2018187747 | A1 | 10/2018 | |

OTHER PUBLICATIONS

Written Opinion in PCT/CN2018/110417 dated Jul. 29, 2019, 4 pages.
Examination Report for Australian Patent Application No. 2018274987 dated Oct. 18, 2019, 5 pages.
Extended European Search Report in European Application No. 18807543.6 dated Jan. 31, 2020, 10 pages.

* cited by examiner

400

600

700

ADAPTIVE TRAFFIC CONTROL USING VEHICLE TRAJECTORY DATA

CROSS-REFERENCE TO RELATED APPLICATION

This application is a continuation of International Application No. PCT/CN2018/110417, filed on Oct. 16, 2018, the contents of which are incorporated herein by reference.

TECHNICAL FIELD

The present disclosure relates to traffic control, and more particularly, to systems and methods for adaptive traffic control using vehicle trajectory data.

BACKGROUND

Traffic lights control the timing of traffic flows in the various directions. When the traffic light is green for a certain traffic flow direction, i.e., left turn for south bound traffic, vehicles in other directions are stopped. The length of that green light, known as green split, determines how long a queue traffics in each of the stopped direction will accumulate. Therefore, the phases and lengths of the green lights need to be controlled according to the traffic conditions in the various directions.

Existing traffic light controls are typically performed at individual traffic lights by their respective controllers. A traffic light is thus not coordinated with nearby traffic lights in order to control traffic flows in a large region. Further, existing traffic light controls rely on data acquired by fixed sensors (e.g., loop detectors, geomagnetic detectors, or video sensors that placed in strategic locations). However, the ability of fixed sensors to provide sufficient traffic information is limited due to its immobility. For example, insufficiency of detector coverage (e.g., in small cities or rural area where inadequate detectors are established) and damaged or malfunctioning detectors (e.g., due to deficient manpower for conducting routinely check) may reduce the quality and quantity of the data provided by fixed sensors. As a result, fixed sensors cannot obtain reliable data on continuous vehicle speeds, queue lengths, etc. Data acquisition by fixed sensor is also not cost-effective due to the infrastructure that needs to be installed, labor needed for maintaining and repairing the equipment, etc.

In addition, existing traffic light controls also rely heavily on human interventions. For example, traffic condition detection and reporting are performed by policemen or traffic patrols. Recording and downloading of traffic control schemes are performed by traffic engineers. Infrastructure maintained (such as fixed sensors) need to be done by experienced maintenance crews. The manual tasks performed as part of the existing traffic controls make the controls inevitably expensive.

Embodiments of the disclosure address the above problems by improved methods and systems for adaptive traffic control using vehicle trajectory data.

SUMMARY

Embodiments of the disclosure provide a traffic control system. The traffic control system may include a communication interface configured to receive vehicle trajectory data acquired by sensors and traffic control data from traffic signal controllers. The traffic control system may further include at least one processor. The at least one processor may be configured to detect an abnormal traffic condition. The at least one processor may be further configured to optimize an online traffic control scheme based on the vehicle trajectory data by adjusting green splits for a plurality of phases. The at least one processor may be also configured to provide, in real-time, the optimized online traffic control scheme to a traffic signal controller for generating traffic control signals.

Embodiments of the disclosure also provide a traffic control method. The traffic control method may include receiving, by a communication interface, vehicle trajectory data acquired by sensors and traffic control data from traffic signal controllers. The traffic control method may further include detecting, by at least one processor, an abnormal traffic condition. The traffic control method may also include optimizing, by the at least one processor, an online traffic control scheme based on the vehicle trajectory data by adjusting green splits for a plurality of phases. Moreover, the traffic control method may include providing, in real-time, the optimized online traffic control scheme to a traffic signal controller for generating traffic control signals.

Embodiments of the disclosure further provide a non-transitory computer-readable medium having instructions stored thereon that, when executed by at least one processor, causes the at least one processor to perform a traffic control method. The traffic control method may include receiving vehicle trajectory data acquired by sensors and traffic control data from traffic signal controllers. The traffic control method may further include detecting an abnormal traffic condition. The traffic control method may also include optimizing an online traffic control scheme based on the vehicle trajectory data by adjusting green splits for a plurality of phases. Moreover, the traffic control method may include providing, in real-time, the optimized online traffic control scheme to a traffic signal controller for generating traffic control signals.

It is to be understood that both the foregoing general description and the following detailed description are exemplary and explanatory only and are not restrictive of the invention, as claimed.

DETAILED DESCRIPTION

Reference will now be made in detail to the exemplary embodiments, examples of which are illustrated in the accompanying drawings. Wherever possible, the same reference numbers will be used throughout the drawings to refer to the same or like parts.

Crowdsourced vehicle trajectory data can provide a low-cost, continuous and reliable data source for traffic signal control. Embodiments of the present disclosure provide an adaptive traffic signal control system based on trajectory data to optimize time-of-day (TOD) schedule, cycle length, offset periodically (e.g., every few days) and green splits in real-time (e.g., at a second or minute level). The disclosed system consists of four main components: data acquisition, traffic diagnosis, traffic control scheme optimization, and performance evaluation. Real-time trajectory data are received from vehicles and traffic control data (e.g., signal parameters) are received from connected signal controllers. The traffic diagnosis unit detects abnormal traffic conditions such as real-time oversaturation and spillover at certain road sections. The traffic control scheme optimization unit consists of two modules: 1) a periodical optimization module and 2) a real-time optimization module. In some embodiments, the periodical optimization module optimizes an offline control scheme that specifies the TOD schedule, the cycle length, phase offset, and green splits, and periodically replaces the existing control scheme with the optimized one. In some embodiments, the real-time optimization module optimizes an online traffic control scheme based on the vehicle trajectory data by adjusting green splits for the different phases, and provides the optimized traffic control scheme to traffic signal controllers in real-time for generating control signals. The performance evaluation unit evaluates six performance indexes related to the traffic flows.

Figure 1:
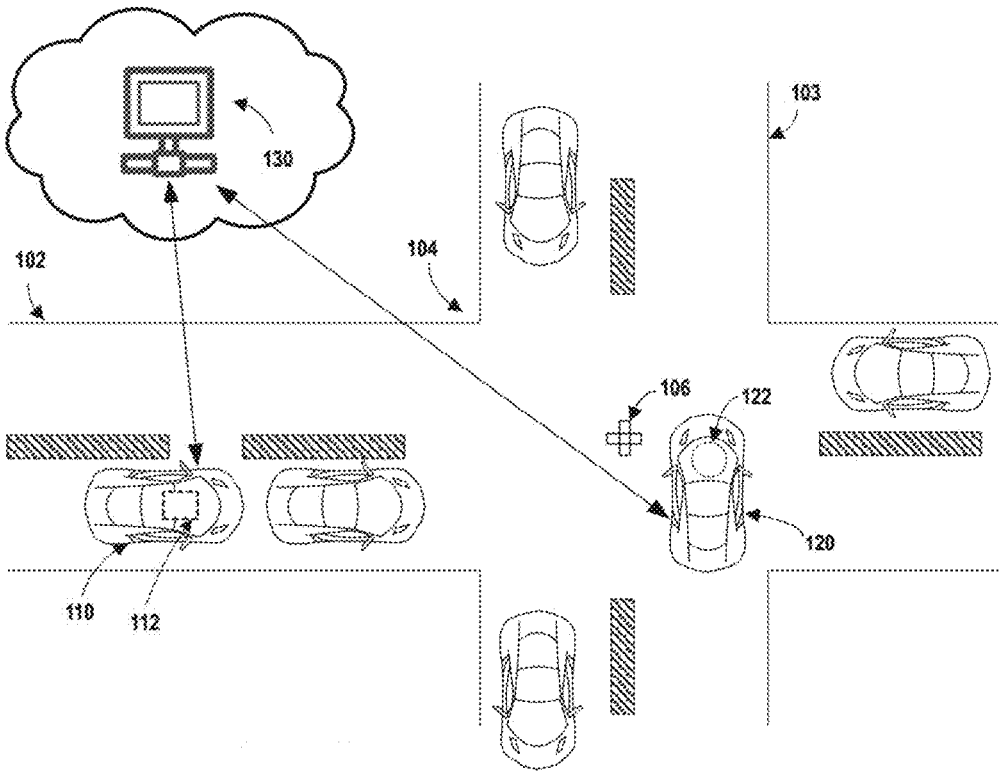
FIG. 1 illustrates an exemplary scene of intersection traffic, according to embodiments of the disclosure.

FIG. 1 illustrate an exemplary scene of traffic conditions at an intersection. As shown in FIG. 1, multiple vehicles may travel along intersecting roads 102 and 103 and may be controlled by a traffic light at an intersection 104. Intersection 104 may include a stop bar 108 in each direction, which may serve as a landmark for vehicles to stop, waiting for the green light. It is noted that, although intersection 104 shown in FIG. 1 is an intersection between two roads with a traffic light placed in the center, such simplification is exemplary and for illustration purposes only. Embodiments disclosed herein are applicable to any forms of intersections with any suitable configuration of traffic lights.

The signaling of the traffic light is controlled by a traffic signal controller 106. In some embodiments, traffic signal controller 106 may be mounted inside a cabinet. Traffic signal controller 106 may be electro-mechanical controllers or solid-state controllers. Traffic signal controller may be configured to generate various traffic control signals according a control scheme. In some embodiments, other than traffic signal controller 106, the controller cabinet may additionally contain other components, such as a power panel to distribute electrical power, a conflict monitor unit that ensures fail-safe operation, flash transfer relays, and a police panel to allow the police to disable the signal.

A traffic control scheme, according to which traffic signal controller 106 operates, may include a TOD scheme that divides the time of a day into different periods, so that different controls may be applied to the different periods. For example, a TOD scheme may include periods 5:00 am-7:00 am (early inbound rush hours), 7:00 am-9:00 am (inbound rush hours), 9:00 am-11:00 am (late inbound rush hours), 11:00 am-3:00 pm (light daytime traffic period), 3:00 pm-5:00 pm (early outbound rush hours), 5:00 pm-7:00 pm (outbound rush hours), 7:00 pm-9:00 pm (late outbound rush hours), and 9:00 pm-5:00 am (nighttime traffic period). The TOD scheme may be different based on the city and particular location where traffic signal controller 106 is located at.

For each controlling period in the TOD schedule, the traffic control scheme further specifies the controls by phases and stages. Consistent with the present disclosure, a phase refers to a traffic flow direction. For example, intersection 104 may have 12 (i.e., 4×3) vehicle movement phases, one for traffic flow direction. These 12 phases may include: west straight, east straight, north straight, south straight, west left, east left, north left, south left, west right, east right, north right, and south right. In some embodiments, there may be additional phases for other movements such as pedestrians, cyclists, bus lanes or tramways. Consistent with the present disclosure, a stage is a group of non-conflicting phases which move at the same time.

The traffic control scheme controls each phase in cycles. Consistent with the present disclosure, a cycle is defined as the total time to complete one sequence of signalization for all movements at an intersection. Accordingly, a cycle length defines the time required for a complete sequence of indications. The traffic control scheme may specify the cycle length, such as 120 seconds, 110 seconds, 100 seconds, depending on how frequently the traffic signal needs to switch at the location.

The traffic control scheme also specifies the green split(s) within each cycle. Within a cycle, splits are the portion of time allocated to each phase at an intersection. The splits are determined based on the intersection phasing and expected demand. Splits can be expressed either in percentages of the cycle or in seconds. A cycle typically consists of green split(s), yellow split(s), and red split(s). The traffic control scheme may also specify the starting time and ending time of each green split. In addition, in embodiments where coordinated phase assignment is implemented, e.g., to let driver experience a green wave, the traffic control scheme may also specify an offset, which is a time relationship between coordinated phases at subsequent traffic signals. Offset may be expressed in either seconds or as a percent of the cycle length.

Consistent with some embodiments, instead of using fixed sensors to acquire traffic data, the disclosed traffic control system uses vehicle trajectory data. In some embodiments, a trajectory sensing system 112 onboard of vehicles, such as vehicle 110, may be used to acquire vehicle trajectory data as the vehicles move. Trajectory sensing system 112 may be a standalone device or integrated inside another device, e.g., a vehicle, a mobile phone, a wearable device, a camera, etc. It is contemplated that trajectory sensing system 112 may be any kind of movable device or equivalent structures equipped with any suitable satellite navigation module that enables trajectory sensing system 112 to obtain trajectory data.

In one example, some vehicles, such as vehicle 110, may be equipped with trajectory sensing system 112, which may obtain trajectory data including the location and time information relating to the movement of vehicle 110. The trajectory data may be sent to a server 130. In another example, trajectory sensing system 112 may be equipped in a terminal device 122 (e.g., a mobile phone) carried by a driver of a vehicle, such as vehicle 120. In some embodiments, terminal device 122 may run a mobile program capable of collecting trajectory data using trajectory sensing system 112. For instance, the driver may use terminal device 122 to run a ride hailing or ride sharing mobile application, which may include software modules capable of controlling trajectory sensing system 112 to obtain location, time, speed, and/or pose information of vehicle 120. Terminal device 122 may communicate with server 130 to send the trajectory data to server 130.

Figure 2:
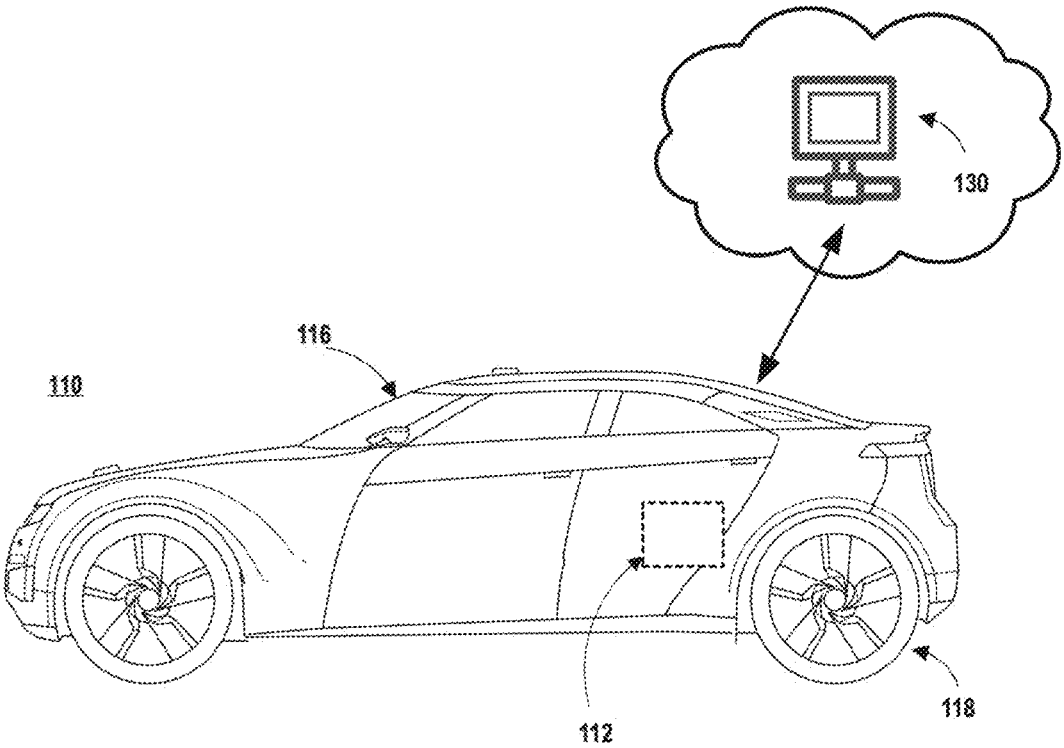
FIG. 2 illustrates a schematic diagram of an exemplary vehicle equipped with a trajectory sensing system, according to embodiments of the disclosure.

FIG. 2 illustrates a schematic diagram of an exemplary vehicle 110 having trajectory sensing system 112, according to embodiments of the disclosure. It is contemplated that vehicle 110 may be an electric vehicle, a fuel cell vehicle, a hybrid vehicle, or a conventional internal combustion engine vehicle. Vehicle 110 may have a body 116 and at least one wheel 118. Body 116 may be any body style, such as a sports vehicle, a coupe, a sedan, a pick-up truck, a station wagon, a sports utility vehicle (SUV), a minivan, or a conversion van. In some embodiments, vehicle 110 may include a pair of front wheels and a pair of rear wheels, as illustrated in FIG. 2. However, it is contemplated that vehicle 110 may have more or less wheels or equivalent structures that enable vehicle 110 to move around. Vehicle 110 may be configured to be all wheel drive (AWD), front wheel drive (FWR), or rear wheel drive (RWD). In some embodiments, vehicle 110 may be configured to be operated by an operator occupying the vehicle, remotely controlled, and/or autonomously controlled.

As illustrated in FIG. 2, vehicle 110 may be equipped with trajectory sensing system 112. In some embodiments, trajectory sensing system 112 may be mounted or attached to the outside of body 116. In some embodiments, trajectory sensing system 112 may be equipped inside body 116, as shown in FIG. 2. In some embodiments, trajectory sensing system 112 may include part of its component(s) equipped outside body 116 and part of its component(s) equipped inside body 116. It is contemplated that the manners in which trajectory sensing system 112 can be equipped on vehicle 110 are not limited by the example shown in FIG. 2, and may be modified depending on the types of sensor(s) included in trajectory sensing system 112 and/or vehicle 110 to achieve desirable sensing performance.

In some embodiments, trajectory sensing system 112 may be configured to capture live data as vehicle 110 travels along a path. For example, trajectory sensing system 112 may include a navigation unit, such as a GPS receiver and/or one or more IMU sensors. A GPS is a global navigation satellite system that provides location and time information to a GPS receiver. An IMU is an electronic device that measures and provides a vehicle's specific force, angular rate, and sometimes the magnetic field surrounding the vehicle, using various inertial sensors, such as accelerometers and gyroscopes, sometimes also magnetometers.

It is contemplated that the satellite navigation system from which trajectory sensing system 112 receives signals may be a global navigation satellite system such as a Global Positioning System (GPS), a Global Navigation Satellite System (GLONASS), a BeiDou-2 Navigation Satellite System (BDS) or a European Union's Galileo system. The satellite navigation system may also be a regional navigation satellite system such as a BeiDou-1 system, a NAVigation with Indian Constellation (NAVIC) system or a Quasi-Zenith Satellite System (QZSS). Trajectory sensing system 112 may be a high sensitivity GPS receiver, a conventional GPS receiver, a hand-held receiver, an outdoor receiver, or a sport receiver. In some embodiments, trajectory sensing system 112 may be connected to the satellite directly, through Assisted or Augmented GPS, through an intermediary device (e.g., a cell tower or a station), or via any other communication method that could transmit satellite signals (e.g., satellites broadcast microwave signals) or provide orbital data or almanac for the satellite (e.g., Mobile Station Based assistance) to trajectory sensing system 112.

In addition, trajectory sensing system 112, directly or through vehicle 110 and terminal device 122, may be connected to server 130 via a network, such as a Wireless Local Area Network (WLAN), a Wide Area Network (WAN), wireless networks such as radio waves, a cellular network, a satellite communication network, and/or a local or short-range wireless network (e.g., Bluetooth™) for transmitting vehicle navigation information.

Figure 3:
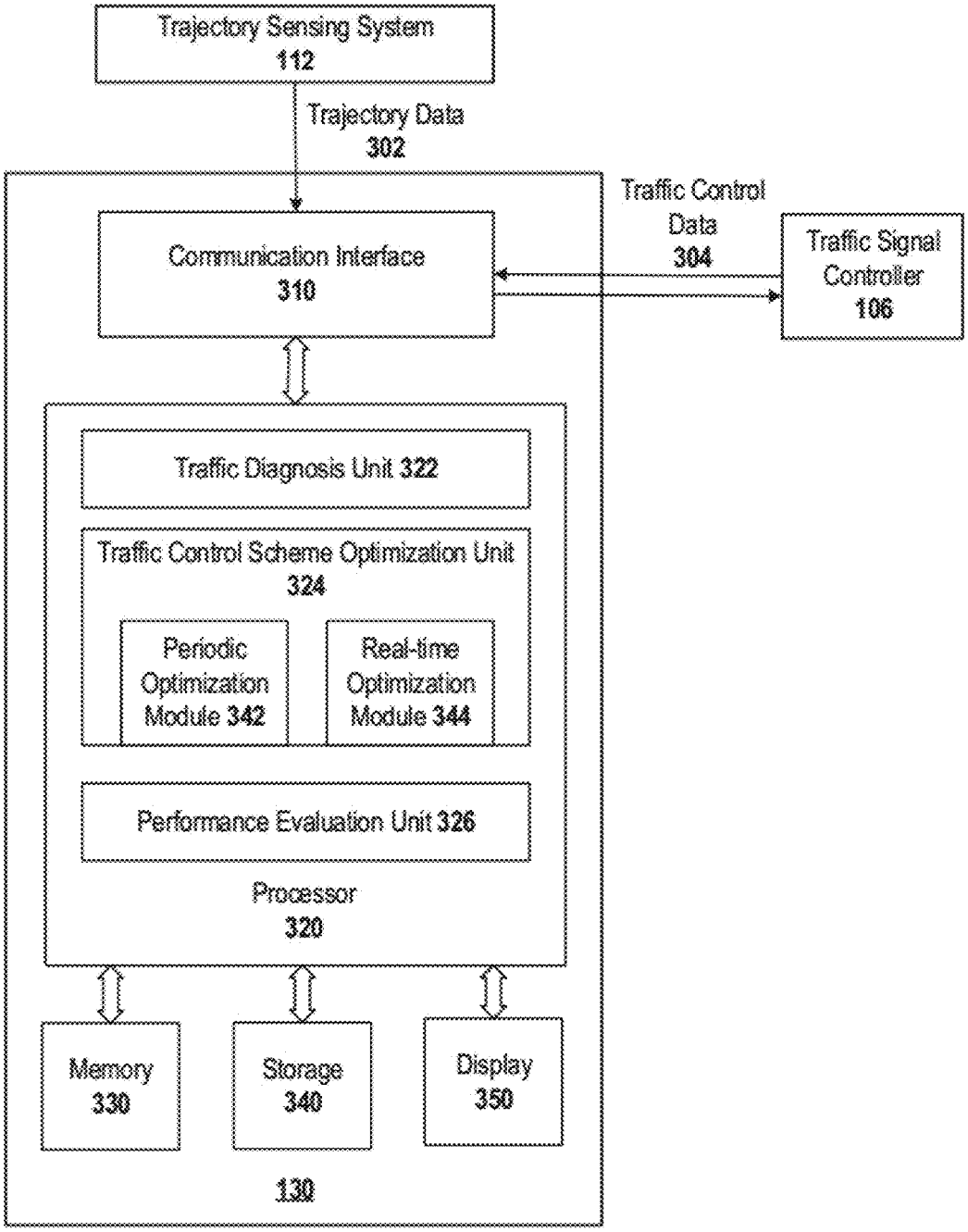
FIG. 3 illustrates a block diagram of an exemplary traffic control system, according to embodiments of the disclosure.

Trajectory sensing system 112 may communicate with server 130 to transmit the sensed trajectory data to server 130, directly or through vehicle 110 and terminal device 122. Server 130 may be a local physical server, a cloud server (as illustrated in FIGS. 1 and 2), a virtual server, a distributed server, or any other suitable computing device. Consistent with the present disclosure, server 130 may store a database of trajectory data received from multiple vehicles, which can be used to estimate saturation flows at intersections. 100331 FIG. 3 shows an exemplary server 130, according to embodiments of the disclosure. Consistent with the present disclosure, server 130 may receive trajectory data 302 associated with one or more vehicles (e.g., acquired by trajectory sensing system 112 and transmitted to server 130 by vehicle 110 or terminal device 122). Trajectory data 302 may include vehicle location and time information that describes a movement trajectory of a vehicle. In some embodiments, as vehicle 110 travels along the trajectory, a trace in geographical space associated with vehicle 110's movement is generated. For example, trajectory data 302 may include a series of chronologically ordered points, e.g. $p1 \rightarrow p2 \rightarrow \ldots \rightarrow pn$, where each point consists of a geospatial coordinate set and a timestamp such as $p=(x,y,t)$. In some embodiments, trajectory data 302 may include real-time trajectory data that are acquired and provided to server 130 contemporaneously with the traffic control, and historical trajectory data that are acquired in the past.

Consistent with the present disclosure, server 130 may receive traffic control data 304 from traffic signal controller 106. Traffic control data 304 may include control parameters specified by the existing traffic control schemed used by traffic signal controller 106. In some embodiments, traffic control data 304 may include a TOD schedule including various controlling periods, phases and a cycle length within each controlling period, and green splits for each phase. In some embodiments, if coordinated phase assignment used between traffic lights, traffic control data 304 may further include an offset specifying the time relationship between the coordinated lights.

In some embodiments, as shown in FIG. 3, server 130 may include a communication interface 310, a processor 320, a memory 330, a storage 340, and a display 350. In some embodiments, server 130 may have different modules in a single device, such as an integrated circuit (IC) chip (implemented as an application-specific integrated circuit (ASIC) or a field-programmable gate array (FPGA)), or separate devices with dedicated functions. In some embodiments, one or more components of server 130 may be located in a cloud, or may be alternatively in a single location (such as inside vehicle 110 or a mobile device) or distributed locations. Components of server 130 may be in an integrated device, or distributed at different locations but communicate with each other through a network (not shown).

Communication interface 310 may send data to and receive data from vehicle 110 or its components such as trajectory sensing system 112 and/or terminal device 122 via communication cables, a Wireless Local Area Network (WLAN), a Wide Area Network (WAN), wireless networks such as radio waves, a cellular network, and/or a local or short-range wireless network (e.g., Bluetooth™), or other communication methods. In some embodiments, communication interface 310 can be an integrated services digital network (ISDN) card, cable modem, satellite modem, or a modem to provide a data communication connection. As another example, communication interface 310 can be a local area network (LAN) card to provide a data communication connection to a compatible LAN. Wireless links can also be implemented by communication interface 310. In such an implementation, communication interface 310 can send and receive electrical, electromagnetic or optical signals that carry digital data streams representing various types of information via a network.

Consistent with some embodiments, communication interface 310 may receive trajectory data 302 acquired by trajectory sensing system 112. Consistent with some embodiments, communication interface 310 may also receive traffic control data 304 used by traffic signal controller 106. Communication interface 310 may further provide the received trajectory data 302 and traffic control data 304 to storage 340 for storage or to processor 320 for processing.

Processor 320 may include any appropriate type of general-purpose or special-purpose microprocessor, digital signal processor, or microcontroller. Processor 320 may be configured as a stand-alone processor module dedicated to traffic control. Alternatively, processor 320 may be configured as a shared processor module for performing other functions unrelated to traffic control.

As shown in FIG. 3, processor 320 may include multiple modules, such as a traffic diagnosis unit 322, a traffic control scheme optimization unit 324, and a performance evaluation unit 326, and the like. These modules (and any corresponding sub-modules or sub-units) can be hardware units (e.g., portions of an integrated circuit) of processor 320 designed for use with other components or software units implemented by processor 320 through executing at least part of a program. The program may be stored on a computer-readable medium, and when executed by processor 320, it may perform one or more functions or operations. Although FIG. 3 shows units 322-326 all within one processor 320, it is contemplated that these units may be distributed among multiple processors located near or remotely with each other.

Traffic diagnosis unit 332 is configured to detect an abnormal traffic condition based on trajectory data 302. In some embodiments, the abnormal traffic condition may be an oversaturation condition indicating that a certain road section in a certain traffic flow direction is too crowded. In some other embodiments, the abnormal traffic condition may be a spillover condition indicating that there is a queue (e.g., jam) at a certain road section in a certain traffic flow direction.

Traffic control scheme optimization unit 324 is configured to optimize the traffic control scheme for traffic signal controller 106 based on trajectory data 302, upon detection of an abnormal traffic condition. In some embodiments, traffic control scheme optimization unit 324 may include a periodic optimization module 342 configured to optimize an offline traffic control scheme based on historical trajectory data. Traffic control scheme optimization unit 324 may further include a real-time optimization module 344 configured to optimize an online traffic control scheme based on real-time trajectory data. Consistent with the present disclosure, an "online" scheme refers to a control scheme that is generated by server 130 based on data collected in real-time and also downloaded by traffic signal controller 106 in real-time for implementation. Consistent with the present disclosure, an "offline" scheme refers to a control scheme that is generated based on previously collected data, and downloaded by traffic signal controller 106 periodically to replace/update its existing control scheme.

In some embodiments, the offline traffic control schemes are optimized by periodic optimization module 342 by adjusting the controlling periods of a TOD schedule, the cycle length within each controlling period, the phases, the green splits for each phase, and the offset between two signal lights. The online traffic control schemes, on the other hand, are optimized by real-time optimization module 344 by adjusting mainly the green splits for each phase, which can be determined by server 130 and implemented by traffic signal controller 106 in real-time. In some embodiments, optimizing the online traffic control scheme may also include adjusting an offset between coordinated phases of two traffic lights.

Figure 4:
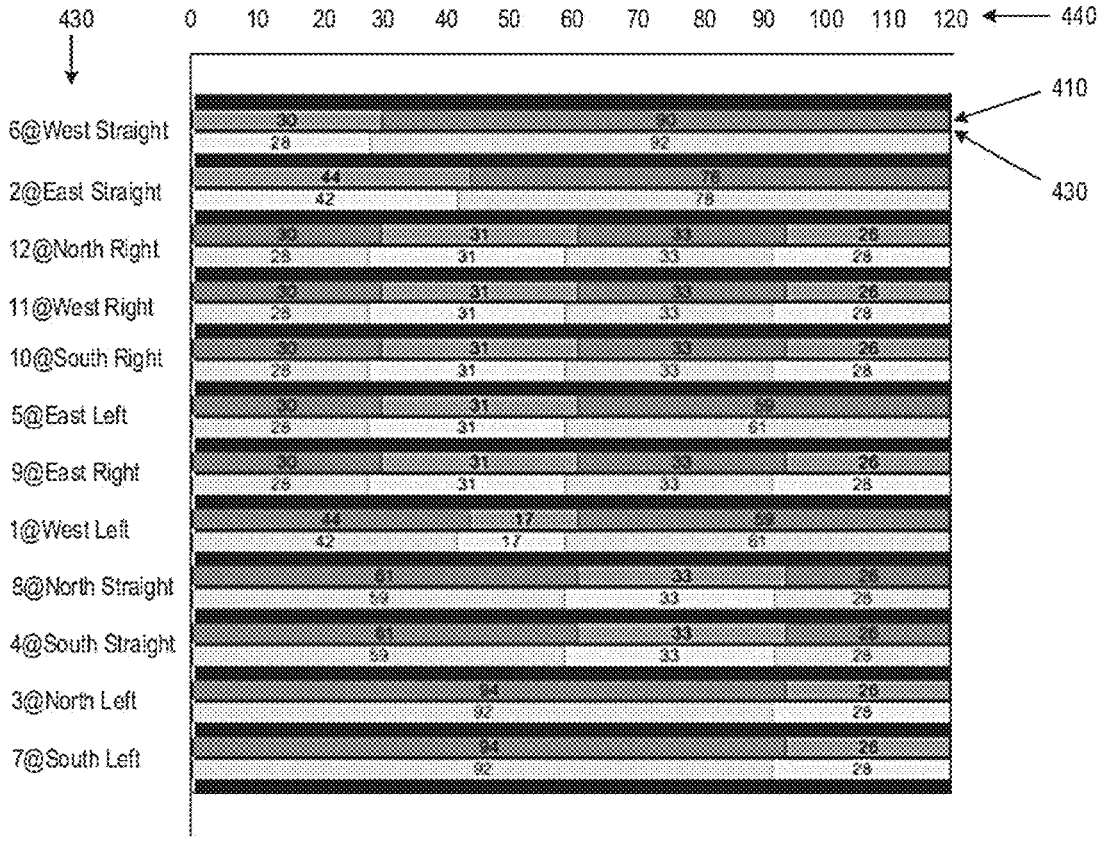
FIG. 4. illustrates an exemplary traffic control scheme including an existing traffic control scheme and an optimized traffic control scheme.

FIG. 4. illustrates an exemplary traffic control scheme 400 including an existing traffic control scheme 410 and an optimized traffic control scheme 420. Schemes 410 and 420 shown by FIG. 4 each have 12 phases 430, including: Phase 1—West Left, Phase 2—East Straight, Phase 3—North Left, Phase 4—South Straight, Phase 5—East Left, Phase 6—West Straight, Phase 7—South Left, Phase 8—North Straight, Phase 9—East Right, Phase 10—South Right, Phase 11—West Right, and Phase 12—North Right. The cycle length 440 as shown in FIG. 4 is 120 seconds. For each phase, scheme 410/420 specifies the green split(s) in the cycle. For example, for phase 6, existing traffic control scheme 410 specifies that the first 30 seconds are green, and the remaining 90 seconds are red. For the same phase, optimized traffic control scheme 420 specifies that the first 28 seconds are green, and the remaining 92 seconds are red. In other words, the optimized traffic control scheme shortens the green time of phase 6 by 2 seconds. As another example, for phase 10, existing traffic control scheme 410 specifies two green splits: first one starts at $31^{st}$ second and lasts for 31 seconds, and the second one starts at the $95^{th}$ second and lasts for 26 seconds. For the same phase, optimized traffic control scheme 420 modifies the first green split to start 2 seconds earlier and last for the same duration, and modifies the second green split to start 2 seconds earlier and last for 28 seconds. In other words, the optimized traffic control scheme prolongs the green time of phase 10 by 2 seconds.

Returning to FIG. 3, performance evaluation unit 236 is configured to evaluate the performance of the optimized traffic control schemes determined by traffic control scheme optimization unit 324. Various evaluation criteria may be applied. For example, performance may be rated according to a formula. Operations of traffic diagnosis unit 322, traffic control scheme optimization unit 324, and performance evaluation unit 326 will be described in more detail in connection with FIGS. 5-7.

Memory 330 and storage 340 may include any appropriate type of mass storage provided to store any type of information that processor 320 may need to operate. Memory 330 and/or storage 340 may be a volatile or non-volatile, magnetic, semiconductor, tape, optical, removable, non-removable, or other type of storage device or tangible (i.e., non-transitory) computer-readable medium including, but not limited to, a ROM, a flash memory, a dynamic RAM, and a static RAM. Memory 330 and/or storage 340 may be configured to store one or more computer programs that may be executed by processor 320 to perform functions disclosed herein. For example, memory 330 and/or storage 340 may be configured to store program(s) that may be executed by processor 320 for traffic control.

Memory 330 and/or storage 340 may be further configured to store information and data used by processor 320. For instance, memory 330 and/or storage 340 may be configured to store trajectory data 302 provided by trajectory sensing system 112 and/or terminal device 122, and traffic control data 304 provided by traffic signal controller 106. Memory 330 and/or storage 340 may also store optimized traffic control schemes, as well intermediary data created during the process. The various types of data nmay be stored permanently, removed periodically, or disregarded immediately after each frame of data is processed.

Processor 320 may render visualizations of various user interfaces to display data related to the optimization process on a display 350. The visualization may include graphics such as maps of the area for traffic control, green splits diagrams, etc., as well as text information. Display 350 may include a display such as a Liquid Crystal Display (LCD), a Light Emitting Diode Display (LED), a plasma display, or any other type of display, and provide a Graphical User Interface (GUI) presented on the display for user input and data display. The display may include a number of different types of materials, such as plastic or glass, and may be touch-sensitive to receive commands from the user. For example, the display may include a touch-sensitive material that is substantially rigid, such as Gorilla Glass™, or substantially pliable, such as Willow Glass™. In some embodiments, display 350 may receive user inputs to make certain selections, such as to select a controlling period of TOD scheme for optimization, or to manually adjust certain traffic control parameters, such as the cycle length, the offset, or the green splits.

Figure 5:
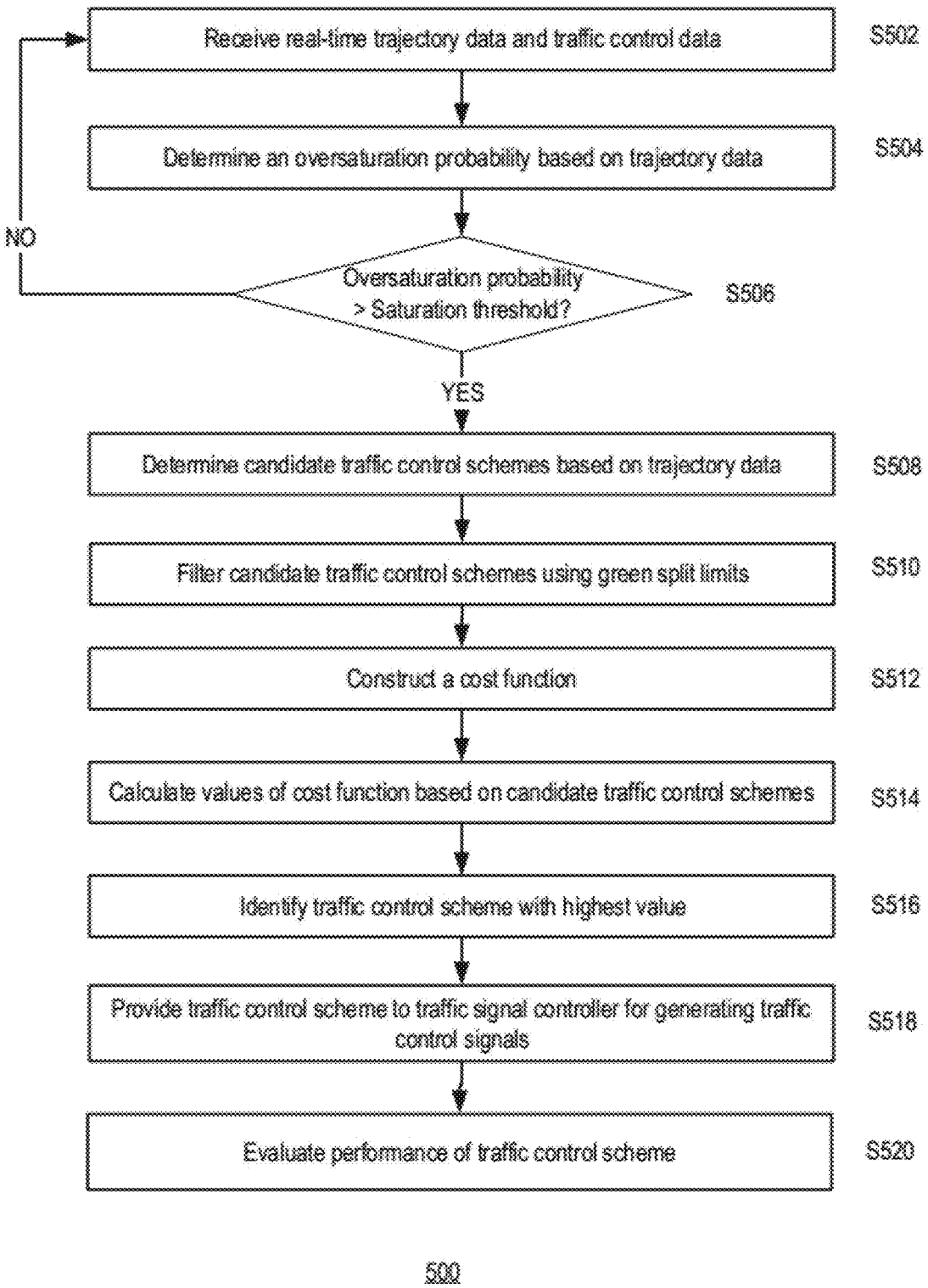
FIG. 5. illustrates a flowchart of an exemplary method for online traffic control upon detection of an oversaturation condition, according to embodiments of the disclosure.
Figure 6:
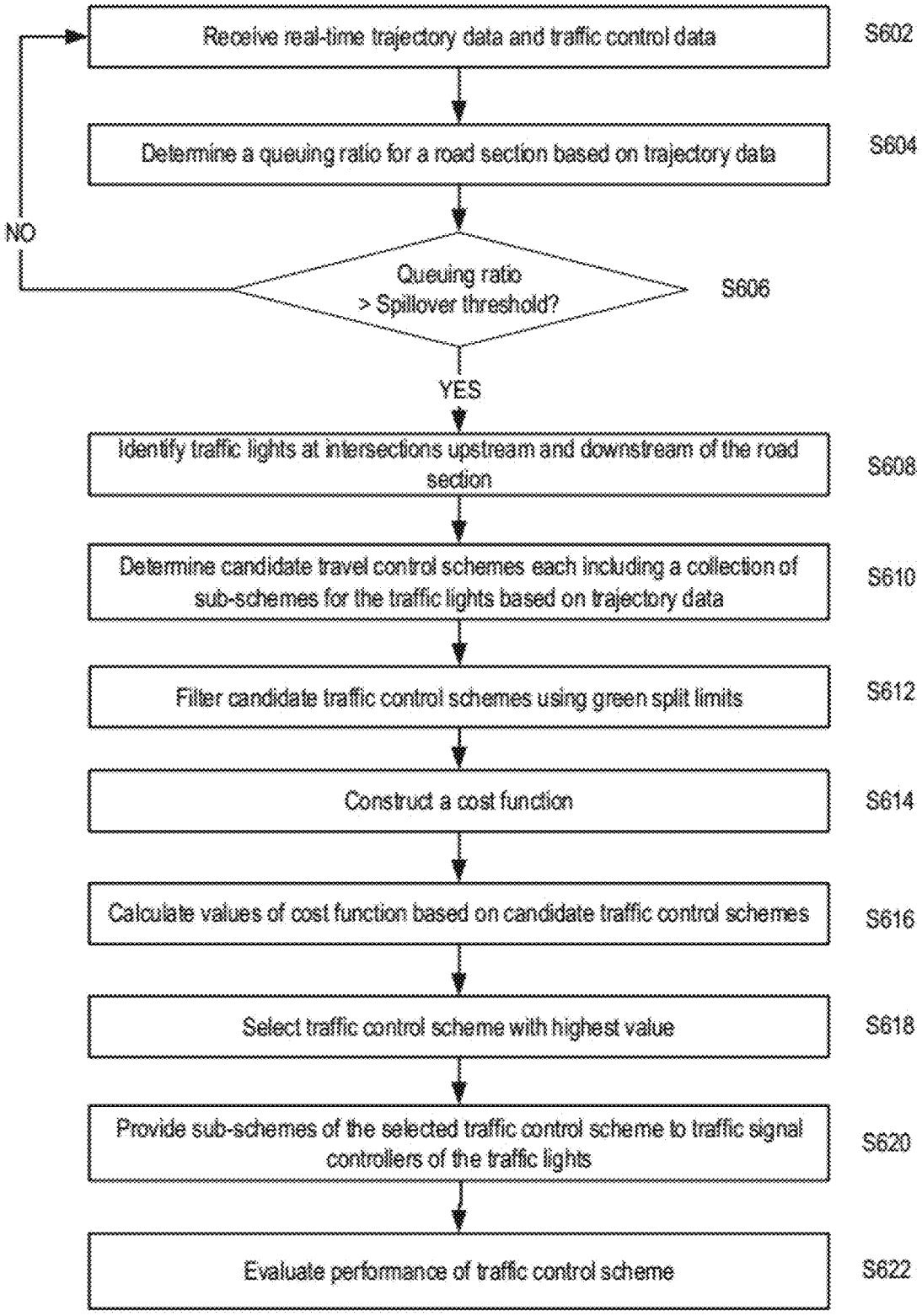
FIG. 6 illustrates a flowchart of an exemplary method for online traffic control upon detection of a spillover condition, according to embodiments of the disclosure.

FIG. 5 illustrates a flowchart of an exemplary method 500 for online traffic control upon detection of an oversaturation condition, according to embodiments of the disclosure. FIG. 6 illustrates a flowchart of an exemplary method 600 for online traffic control upon detection of a spillover condition, according to embodiments of the disclosure. In some embodiments, method 500 and method 600 may be implemented by server 130. However, method 500 and method 500 are not limited to that exemplary embodiment. Method 500 may include steps S502-S520 and method 600 may include steps 602-622 as described below. It is to be appreciated that some of the steps may be optional to perform the disclosure provided herein. Further, some of the steps may be performed simultaneously, or in a different order than shown in FIG. 5 or FIG. 6.

In step S502, processor 320 may receive trajectory data 302 from one or more vehicles (e.g., vehicles 110 and 120) or terminal devices (e.g., terminal devices 122) through communication interface 310. In some embodiments, trajectory data 302 may be related to a plurality of vehicle movements (e.g., vehicles 110 and 120) with respect to an intersection (e.g., intersection 104). For example, trajectory sensing system 112 may capture trajectory data 302 including location and time information. In addition, processor 320 may receive traffic control data 304. For example, traffic control data 304 may include parameters of an existing traffic control scheme used by traffic signal controller 106. Trajectory data 302 and traffic control data 304 may be stored in memory 330 and/or storage 340 as input data for performing traffic control.

In step S504, processor 320 may determine an oversaturation probability based on trajectory data 302. An oversaturation probability may be determined for each traffic flow direction. In step S506, oversaturation probabilities of all the traffic flow directions may be compared with a saturation threshold. If any oversaturation probability exceeds the saturation threshold (step S506: yes), an oversaturation condition is detected and method 500 proceeds to step S508. Otherwise (step S506: no), no oversaturation condition is detected and method 500 returns to step S502.

In step S508, processor 320 determines multiple candidate online traffic control schemes based on trajectory data 302. In some embodiments, each candidate online traffic control scheme has several phases and specifies green splits for each phase. In some embodiments, the green splits for the same phase among different candidate traffic control schemes are different. In step S510, the candidate online traffic control schemes are filtered using green split limits. For example, a range defined by (min green split, max green split) is predetermined based on the hardware limitations of traffic signal controller 106 and/or the traffic light it controls. Candidate online traffic control schemes having green splits outside the range may be removed in step S510.

In step S512, processor 320 may construct a cost function. In some embodiments, the cost function may represent the effectiveness of the traffic control, such as to minimize the probability of oversaturation and/or imbalance of the traffic volumes in the different traffic flow directions. In some embodiments, processor 320 may determine weights based on the oversaturation probabilities determined in step S504, and weigh the traffic flow directions using these weights in the cost function.

In step S514, processor 320 may calculate values of the cost function based on the candidate online traffic control schemes. In step S516, processor 320 may identify the candidate online traffic control scheme with the highest value (i.e., corresponding to most effective control) as the optimized online traffic control scheme. It is contemplated that various other optimization models and methods may be used to optimize the online traffic control scheme different from the example described in step S512-S516. For example, gradient-decent or other iterative methods may be used to solve the optimization.

In step S518, the optimized online traffic control scheme may be provided, in real-time, to traffic signal controller 106 for generating traffic control signals. In some embodiments, the optimized online traffic control scheme may be downloaded by traffic signal controller 106 in real-time. Traffic signal controller 106 may generate control signals according to the optimized online traffic control scheme to implement the new control scheme immediately.

In step S520, processor 320 may evaluate performance of the optimized online traffic control scheme. In some embodiments, processor 320 may continue to receive trajectory data after the optimized online traffic control scheme is effective. In some embodiments, the trajectory data may be classified into three categories: (1) no spillover and only one stop; (2) no spillover and two or more stops; and (3) spillover. The three categories correspond to different traffic conditions. In some embodiments, processor 320 may calculate a performance index (PI) using the three categories of trajectory data:

$$PI=1/(\beta(x_ds))\{1/N[\beta_1(d_1+10\times n_1)+\beta_2(d_2+10\times n_2)+\beta_3(d_3+10\times n_3)]\} \quad (1)$$

where d_i, n_i (i=1, 2, 3) are the total delays and total stops of the three categories, respectively, β_i (i=1, 2, 3) are respective weights for the three categories of trajectories. In some embodiments, the weights may be set as β_1=50%, β_2=10%, and β_3=1%.

Method 600 includes step S602 similar to step S502. In step S604, processor 320 may determine a queuing ratio for a road section based on trajectory data 302. A road section may refer to a portion of a road between two adjacent intersections. In some embodiments, a queuing ratio may be determined for each traffic flow direction. In step S606, queuing ratios of all the traffic flow directions may be compared with a spillover threshold. If any queuing ratio exceeds the spillover threshold (step S606: yes), a spillover condition is detected and method 600 proceeds to step S608. Otherwise (step S606: no), no spillover condition is detected and method 600 returns to step S602. In step S608, processor 320 may identify traffic lights at intersections upstream and downstream of the road section that has the spillover condition. For example, the two intersections at the two ends of the road section may be identified.

Steps S610-S622 may be implemented similarly to steps S508-S520, except, in method 600, each online traffic control scheme (candidate or optimized) includes a collection of sub-schemes for the respective traffic lights identified in step S608. In other words, the online traffic control scheme optimized by method 600 includes control parameters for two traffic lights rather than an individual traffic light. In some embodiments, in step S610, each candidate online traffic control scheme may further specify an offset between the coordinated phases between the two traffic lights. Different offsets may be specified in the different candidate online traffic control schemes. In step S620, sub-schemes of the optimized online traffic control scheme may be provided, in real-time, to the respective traffic signal controllers of the two traffic lights.

Figure 7:
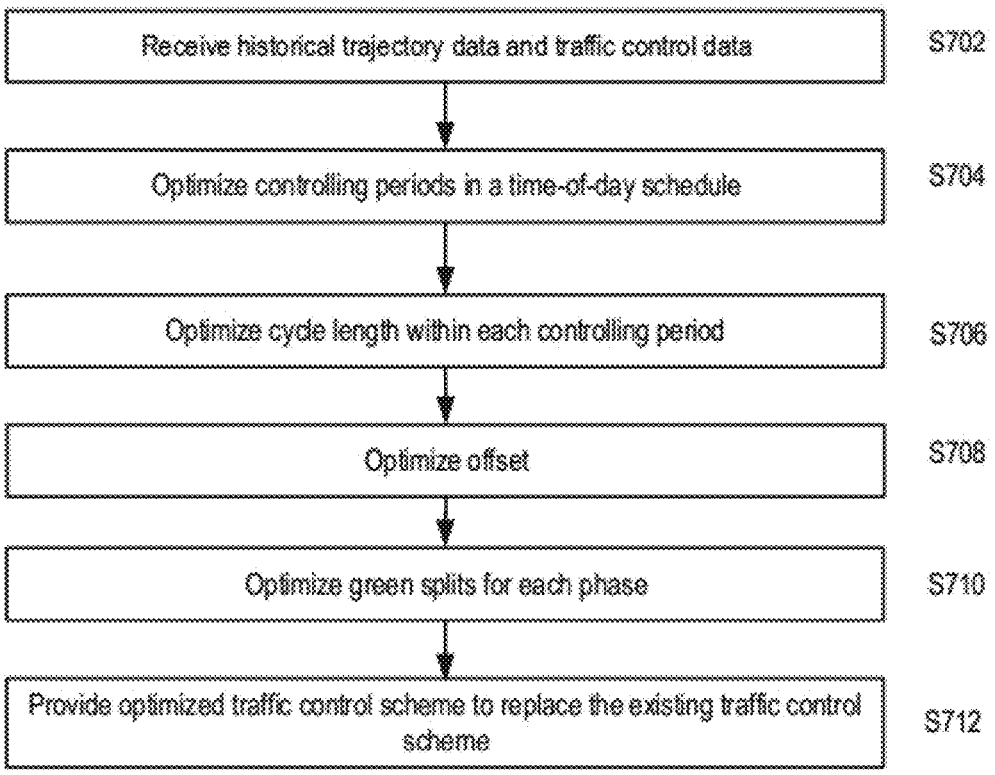
FIG. 7 illustrates a flowchart of an exemplary method for offline traffic control, according to embodiments of the disclosure.

FIG. 7 illustrates a flowchart of an exemplary method 700 for offline traffic control, according to embodiments of the disclosure. In some embodiments, method 700 may be implemented by server 130. However, method 700 is not limited to that exemplary embodiment. Method 700 may include steps S702-S712 as described below. It is to be appreciated that some of the steps may be optional to perform the disclosure provided herein. Further, some of the steps may be performed simultaneously, or in a different order than shown in FIG. 7.

In step S702, processor 320 may receive trajectory data 302 and traffic control data 304 through communication interface 310. In some embodiments, trajectory data 302 may be historical trajectory data acquired by trajectory sensing system 112 days or weeks before method 700 is performed. In some embodiments, traffic control data 304 may include parameters of an existing traffic control scheme used by traffic signal controller 106. Trajectory data 302 and traffic control data 304 may be stored in memory 330 and/or storage 340 as input data for performing traffic control.

In step S704, processor 320 may optimize the controlling periods in the TOD schedule of the traffic control scheme. For example, the existing TOD scheme may include controlling periods 5:00 am-7:00 am (early inbound rush hours), 7:00 am-9:00 am (inbound rush hours), 9:00 am-11:00 am (late inbound rush hours), 11:00 am-3:00 pm (light daytime traffic period), 3:00 pm-5:00 pm (early outbound rush hours), 5:00 pm-7:00 pm (outbound rush hours), 7:00 pm-9:00 pm (late outbound rush hours), and 9:00 pm-5:00 am (nighttime traffic period). In step S704, processor 320 may optimize the TOD schedule by adjusting early inbound rush hours to 5:00 am-6:30 am, and inbound rush hours to 6:30 am-9:00 am, if the historical trajectory data shows that commuter traffic starts to get heavy earlier than 7:00 am.

In step S706, processor 320 may optimize the cycle length within each controlling period. For example, the cycle period of the existing control schedule for inbound rush hours may be 120 seconds, and the optimized cycle period may be shortened to 100 seconds so that the traffic lights are switched more often. In step S708, processor 320 may optimize the offset between coordinated phases of two traffic lights. In some embodiments, the two traffic lights may be adjacent to each other. For example, the offset may be optimized so that traffic lights "cascade" (progress) in sequence so platoons of vehicles can proceed through a continuous series of green lights (also known as a green wave). In step S710, processor 320 may optimize the green splits, similar to steps S508-S516.

In step S712, the optimized offline traffic control scheme may be provided to traffic signal controller 106 to replace or update its existing traffic control scheme. In some embodiments, the optimized offline traffic control scheme may be downloaded by traffic signal controller 106 periodically, e.g., every 3 or 5 days, every week, every two weeks, every month, etc. The download period may be determined based on various factors, including e.g., how often the traffic pattern changes around the area. Traffic signal controller 106 may generate control signals according to the optimized offline traffic control scheme to implement the new control scheme.

Another aspect of the disclosure is directed to a non-transitory computer-readable medium storing instructions which, when executed, cause one or more processors to perform the methods, as discussed above. The computer-readable medium may include volatile or non-volatile, magnetic, semiconductor, tape, optical, removable, non-removable, or other types of computer-readable medium or computer-readable storage devices. For example, the computer-readable medium may be the storage device or the memory module having the computer instructions stored thereon, as disclosed. In some embodiments, the computer-readable medium may be a disc or a flash drive having the computer instructions stored thereon.

It will be apparent to those skilled in the art that various modifications and variations can be made to the disclosed system and related methods. Other embodiments will be apparent to those skilled in the art from consideration of the specification and practice of the disclosed system and related methods.

It is intended that the specification and examples be considered as exemplary only, with a true scope being indicated by the following claims and their equivalents.

What is claimed is:

1. A traffic control system, comprising:

a communication interface configured to:

receive vehicle trajectory data acquired by sensors and traffic control data from traffic signal controllers;

receive historical trajectory data; and at least one processor configured to:

detect an abnormal traffic condition;

optimize an online traffic control scheme based on the vehicle trajectory data by adjusting green splits for a plurality of phases;

provide, in real-time, the optimized online traffic control scheme to a traffic signal controller for generating traffic control signals;

optimize an offline traffic control scheme based on the historical trajectory data by adjusting controlling periods in a time-of-day schedule and cycle lengths within each controlling period; and periodically provide the optimized offline traffic control scheme to the traffic signal controller to replace an existing scheme used by the traffic signal controller.

2. The traffic control system of claim 1, wherein to optimize the traffic control scheme, the at least one processor is configured to:

determine a plurality of candidate traffic control schemes based on the vehicle trajectory data, each candidate traffic control associated with a different set of green splits;

calculate values indicative of effectiveness of the candidate traffic control schemes; and select the candidate traffic control scheme corresponding to the highest value as the optimized online traffic control scheme.

3. The traffic control system of claim 1, wherein the abnormal traffic condition is an oversaturation condition, wherein the at least one processor is further configured to:

determine an oversaturation probability for each traffic flow direction based on the vehicle trajectory data; and detect the oversaturation condition when the oversaturation probability exceeds a saturation threshold.

4. The traffic control system of claim 3, wherein the at least one processor is further configured to:

determine weights for respective traffic flow directions based on the oversaturation probability; and optimize the online traffic control scheme using the weights to weigh conditions in the respective traffic flow directions.

5. The traffic control system of claim 1, wherein the abnormal traffic condition is a spillover condition, wherein the at least one processor is further configured to:

determine a queuing ratio for a road section based on the vehicle trajectory data; and detect the spillover condition when the queuing ratio exceeds a spillover threshold.

6. The traffic control system of claim 5, wherein the at least one processor is further configured to:

identify traffic lights at intersections adjacent to the road section;

optimize the online traffic control scheme including a collection of sub-schemes for the respective identified traffic lights; and provide, in real-time, the sub-scheme to traffic signal controllers of the respective identified traffic lights.

7. The traffic control system of claim 2, wherein the at least one processor is further configured to filter the plurality of candidate traffic control scheme using a predetermined range for green splits.

8. The traffic control system of claim 6, wherein at least one processor is further configured to optimize the online traffic control scheme by adjusting an offset between two of the identified traffic lights.

9. The traffic control system of claim 1, wherein the at least one processor is further configured to optimize the off line traffic control scheme by adjusting an offset between two traffic lights.

10. The traffic control system of claim 1, wherein the at least one processor is further configured to optimize the off line traffic control scheme by adjusting green splits for each phase within each controlling period.

11. A traffic control method, comprising:

receiving, by a communication interface, vehicle trajectory data acquired by sensors and traffic control data from traffic signal controllers;

receiving, by a communication interface, historical trajectory data;

detecting, by at least one processor, an abnormal traffic condition;

optimizing, by the at least one processor, an online traffic control scheme based on the vehicle trajectory data by adjusting green splits for a plurality of phases;

providing, in real-time, the optimized online traffic control scheme to a traffic signal controller for generating traffic control signals;

optimizing, by the at least one processor, an offline traffic control scheme based on the historical trajectory data by adjusting controlling periods in a time-of-day schedule and cycle lengths within each controlling period; and periodically providing, by the at least one processor, the optimized off line traffic control scheme to the traffic signal controller to replace an existing scheme used by the traffic signal controller.

12. The traffic control method of claim 11, wherein optimizing the traffic control scheme further comprises:

determining a plurality of candidate traffic control schemes based on the vehicle trajectory data, each candidate traffic control associated with a different set of green splits;

calculating values indicative of effectiveness of the candidate traffic control schemes; and selecting the candidate traffic control scheme corresponding to the highest value as the optimized online traffic control scheme.

13. The traffic control method of claim 11, wherein the abnormal traffic condition is an oversaturation condition, wherein detecting the abnormal traffic condition further comprises:

determining an oversaturation probability for each traffic flow direction based on the vehicle trajectory data; and detecting the oversaturation condition when the oversaturation probability exceeds a saturation threshold.

14. The traffic control method of claim 11, wherein the abnormal traffic condition is a spillover condition, wherein detecting the abnormal traffic condition further comprises:

determining a queuing ratio for a road section based on the vehicle trajectory data; and detecting the spillover condition when the queuing ratio exceeds a spillover threshold.

15. The traffic control method of claim 14, further comprising:

identifying traffic lights at intersections adjacent to the road section;

optimizing the online traffic control scheme including a collection of sub-schemes for the respective identified traffic lights; and providing, in real-time, the sub-scheme to traffic signal controllers of the respective identified traffic lights.

16. The traffic control method of claim 15, wherein optimizing the online traffic control scheme further includes adjusting an offset between two of the identified traffic lights.

17. The traffic control method of claim 11, wherein optimizing the off line traffic control scheme is further by adjusting green splits for each phase within each controlling period.

18. A non-transitory computer-readable medium having instructions stored thereon, wherein the instructions, when executed by at least one processor, cause the at least one processor to perform a traffic control method, the traffic control method comprising:

receiving vehicle trajectory data acquired by sensors and traffic control data from traffic signal controllers;

receiving historical trajectory data;

detecting an abnormal traffic condition;

optimizing an online traffic control scheme based on the vehicle trajectory data by adjusting green splits for a plurality of phases;

providing, in real-time, the optimized online traffic control scheme to a traffic signal controller for generating traffic control signals;

optimizing an offline traffic control scheme based on the historical trajectory data by adjusting controlling periods in a time-of-day schedule and cycle lengths within each controlling period; and periodically providing the optimized offline traffic control scheme to the traffic signal controller to replace an existing scheme used by the traffic signal controller.

* * * * *